US005926861A

United States Patent [19]

Frost

[11] Patent Number: 5,926,861

[45] Date of Patent: Jul. 27, 1999

[54] DISCHARGE VALVE

[75] Inventor: Douglas Robert David Frost, Birmingham, United Kingdom

[73] Assignee: Derwent MacDee Limited, Doncaster, United Kingdom

[21] Appl. No.: 08/836,679

[22] PCT Filed: Oct. 23, 1995

[86] PCT No.: PCT/GB95/02493

§ 371 Date: Aug. 8, 1997

§ 102(e) Date: Aug. 8, 1997

[87] PCT Pub. No.: WO96/14479

PCT Pub. Date: May 17, 1996

[30] Foreign Application Priority Data

| | | | |
|---|---|---|---|
| Nov. 4, 1994 | [GB] | United Kingdom | 9422286 |
| Jul. 27, 1995 | [GB] | United Kingdom | 9515414 |
| Aug. 23, 1995 | [GB] | United Kingdom | 9517222 |

[51] Int. Cl.[6] ..... E03D 1/34

[52] U.S. Cl. ..... 4/378; 4/324

[58] Field of Search ..... 4/378, 324, 325, 4/326, 327, 405

[56] References Cited

U.S. PATENT DOCUMENTS

| | | | |
|---|---|---|---|
| 4,176,821 | 12/1979 | Strangfeld . | |
| 4,357,720 | 11/1982 | Stahli | 4/378 |
| 4,956,880 | 9/1990 | Bailet | 4/378 |
| 5,331,690 | 7/1994 | Pourcier | 4/378 |
| 5,349,981 | 9/1994 | Schmucki et al. | 4/378 |
| 5,652,970 | 8/1997 | Wodeslavsky | 4/378 |
| 5,653,252 | 8/1997 | Steg et al. | 4/378 |

FOREIGN PATENT DOCUMENTS

| | | |
|---|---|---|
| 0 103 045 | 3/1984 | European Pat. Off. . |
| 2274344 | 9/1995 | United Kingdom . |
| WO 80/00984 | 5/1980 | WIPO . |
| WO 93/05247 | 3/1993 | WIPO . |

*Primary Examiner*—David J. Walczak

*Attorney, Agent, or Firm*—Flynn, Thiel, Boutell & Tanis, P.C.

[57] ABSTRACT

An improved discharge valve comprises an upper housing, an upwardly movable main valve assembly within the housing and forming with the upper part thereof a variable volume upper chamber, a restricted passage between the upper chamber and the exterior thereof, an outlet leading down from the lower part of the housing, a seat for the main valve assembly at the entry to the outlet so that, in the lowered position of the main valve assembly, the outlet is blocked against ingress of fluid in which the device is immersed, and a pilot stem actuable remotely from the housing to put the upper chamber in free communication with the outlet. The arrangement being such that, once such free communication is established, fluid escapes the upper chamber and the change in relative pressures above and below the main valve assembly causes the latter to unseat thereby permitting flow of the immersing fluid into the outlet and its substantially complete discharge. The cessation of flow of the immersing fluid allows the main valve assembly to revert to its seated position with the pilot stem cutting off free communication, and air penetrates the upper chamber and on replenishment of immersing fluid, a net downward pressure is created on the main valve assembly to keep it seated. The pilot valve has a hollow stem communicating to atmosphere above the normal full set level of fluid in the cistern. The main valve assembly and the hollow stem define therebetween a hollow annulus.

15 Claims, 6 Drawing Sheets

DISCHARGE VALVE

FIELD OF THE INVENTION

This invention relates to a discharge valve and is primarily intended to provide a light action, easily operable, fast flowing valve assembly for emptying or partly emptying cisterns and other types of liquid storage containers. It is particularly, although not exclusively applicable to being used to reduce the amount of water used for flushing domestic toilets or water closets.

BACKGROUND OF THE INVENTION

For a great many years flushing toilets, pans and bowls have been in existence, and the water closet in one form or another, is common place in all modem homes. With the conventional low flush or close coupled toilet cistern and pan, the means for achieving the flush consists either of a siphon (which at present for the U. K. is still the only acceptable device that meets the water byelaws) or one of a number of non-siphon type valves used extensively on the continent and elsewhere in the world.

These non-siphon on direct type valves, have a valve plate or member which covers and seals the outlet to prevent water from escaping unintentionally. Both the siphon and the direct type flush valve have a threaded outlet pipe which extends downwards through the bottom of the cistern into which it is fixed by a bulkhead fitting. It is then connected to the toilet pan either directly or by a short length of pipe.

With the sole means of flushing or cleaning the pan being the water discharge from the cistern 1 the effectiveness of the flush is mainly dependent on flow rate. Most siphons do not have a good flow rate and require a considerable amount of water to achieve a satisfactory flush; moreover they are sensitive to changes in water level setting and most do not perform satisfactorily below a medium level setting. With some-siphon installations, the flow rates are so low that in some cases more than one flush-is necessary.

Non-siphon type valves generally achieve greater flow rates and with the kinetic energy of the water in the pan approximately doubling for a 50% increase in flow rate, less water is required for an effective flush. In fact the performance of most U. K. toilet pans could be considerably improved by replacing the siphon with a direct discharge valve. Some existing installations in the U. K. and elsewhere would accommodate even higher flow rates than are generally available with existing flush valves. For new installations, by designing the galleries and contours of the pan and cistern in conjunction with a high performance non-siphon flush valve, the quantity of water required for effective flushing could be substantially reduced. For instance with a valve of the type described in this specification installed in the U. K. the amount of water required could be reduced from 7 liters to 3.5–4.5 liters full flush capacity for all installations since January 1993 and from 9 liters to 3.5–4.5 liters for installations prior to then. Moreover when the valve is operated in its short flush mode only 1.5–2.0 liters are required.

In my patent GB-B-2274344 I have described a discharge valve of improved performance and the present invention aims to provide further improvements in this respect.

Accordingly it is an object of the present invention to provide a fluid outlet valve to increase and enhance the performance of water closets.

It is a further object to provide a valve that can operate a full or partial flush, a so-called dual flush valve.

It is also an object to provide a convenient overflow means through the valve, with the added advantage of the quantity of water required for fully or partly flushing being considerably reduced.

SUMMARY OF THE INVENTION

Accordingly the invention provides a device, for immersion in a fluid in a cistern, which comprises an upper housing, an upwardly moveable main valve assembly within the housing and forming with the upper part thereof a variable volume upper chamber, a pressure balance hole between the upper chamber and the surrounding exterior and an outlet leading down from the lower part of the housing, a seat for the main valve assembly at the entry to the outlet, so that in the lowered position of the main valve assembly the outlet is blocked against the ingress of fluid in which the device is immersed, and a pilot valve, actuable remotely from the housing to put the upper chamber in free communication with the outlet, the arrangement being such that on this free communication being established fluid is ejected from the upper chamber and the change in relative pressures above and below the main valve assembly causes the latter to unseat, thereby permitting flow of the immersing fluid into the outlet and, on its substantially complete discharge, the cessation of flow allows the main valve assembly to revert to its seated position with the pilot valve cutting off said free communication and air penetrates the upper chamber and on replenishment of immersing fluid a net downward pressure is created on the main valve assembly to keep it seated, wherein the pilot valve has a hollow stem, the stem communicating to atmosphere above the desired full level of fluid in the cistern, the main valve and hollow stem defining therebetween a hollow annulus.

Thus the main path for free communication between the upper chamber and the outlet is via the hollow annulus between the main valve assembly (piston) and the pilot valve stem.

The hollow stem protruding above the normal full level of the fluid in the cistern provides a convenient and efficient discharge route for fluid to the outlet, should the fluid level rise above the desired normal full level. Thus an overflow route is conveniently provided through the discharge valve.

To provide a dual flush facility, in addition to the main path for free communication; the upper chamber may, for example, be arranged to initially communicate with the interior of the hollow stem, the top of which is open to atmosphere. This additional communication is enabled, for example, by slots in the hollow stem above the pilot seat and sealed from the upper chamber such that only on depression of the pilot stem is communication between the upper chamber and its hollow stem established.

Maintaining this additional free communication by keeping the hollow stem depressed causes downwardly acting forces provided by spring or drag means to overcome the progressively reducing upward forces on the piston thereby resulting in air being drawn into the upper chamber followed by rapid premature reseating of the main valve assembly and as such providing the means of interrupting the discharge to provide a short flush facility. Thus in this way, either approximately half the contents of the cistern can be discharged by holding the pilot stem down for a few seconds, e.g. 2 or 3 seconds, or the contents can be fully discharged by actuating the pilot stem and releasing it straight afterwards. Where drag forces are used in the dual flush embodiment, they may be provided by suitable projections on the lower part of the main valve assembly.

On cessation of flow of the immersing fluid (with the fluid level having fallen to a level either to an intermediate level or to a level slightly above the valve seat) air enters either through slots or ports in the hollow stem or via the bottom of the main valve assembly allowing it to descend and revert to its seated position with the pilot valve cutting off free communications. As refilling takes place, some immersing fluid penetrates the upper chamber via the pressure balance hole to create a net downward force on the main valve assembly and thereby keeping it seated. This in some cases may also be assisted by initial compression of a control spring pressing down on top of the piston.

The immersing fluid, particularly for discharge systems of the W. C. type will of course, be water and the invention will hereafter be described with reference to water for convenience.

Alternatively this additional free communication for the short flush operation may be achieved using an auxiliary valve offset from the hollow stem and providing a vent to the upper chamber.

With all preferred embodiments the free communication of pressure with the valve seated and the cistern filled, is via one or more pressure balance holes between the outside of the main valve assembly and the inside of the upper chamber. To a lesser degree additional communication can occur between the outside of the main valve member and bore of the upper housing, but this can be kept to an insignificant amount by a centralising piston ring fitted at the top of the main valve assembly. The pilot valve which, when seated, closes off the upper chamber from the lower main valve assembly, hollow stem interior and outlet, co-operates with the pressure balance hole to open or close it and allow only a restricted flow of water into and out from the upper chamber. With the main preferred configuration of the valve, the pilot valve is moved downwards to open said passage and the main valve assembly rises to the top of the upper chamber where it remains until either the intermediate level is reached with the pilot valve held depressed or until the cistern is emptied by the pilot valve being depressed and immediately released.

The upper chamber and inside the main valve assembly contain air and a small amount of water which enters through the pressure balance hole(s). On operation of the pilot valve, air and a very small amount of water that is being expelled from the upper chamber by the rapidly rising main valve assembly enters the annular cylindrical space within the main valve assembly and flows downwards outside of the hollow pilot stem extension (and also in some embodiments through slots in the stem wall either above or below the pilot valve) and then down into the outlet.

Water savings of between 60 and 80% over conventional valves may be achieved by the present invention, while providing a convenient overflow provision through the valve.

BRIEF DESCRIPTION OF THE DRAWINGS

For better understanding of the invention, various embodiments will now be described by way of example only with reference to the accompanying drawings, wherein.

DETAILED DESCRIPTION

Figure 1:
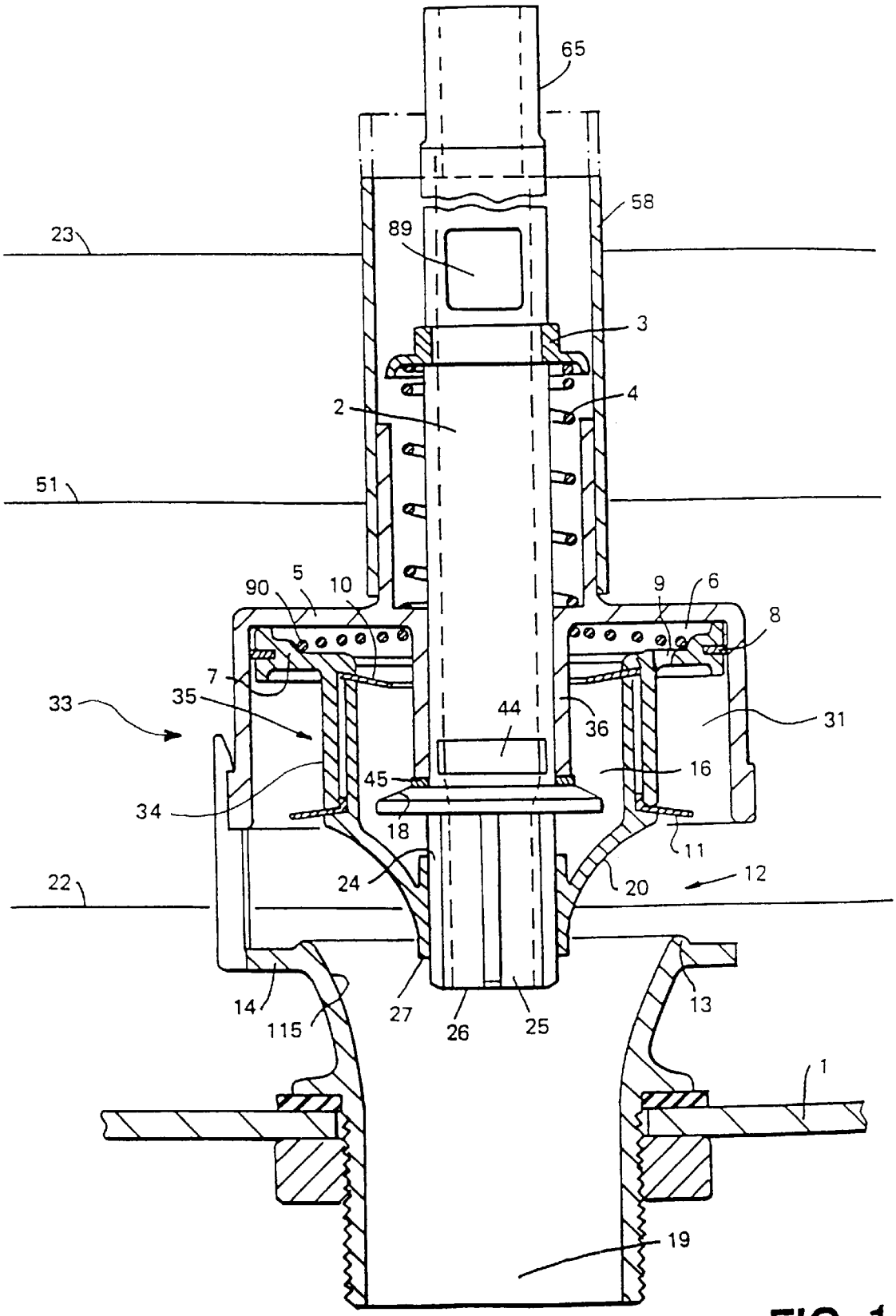
FIG. 1 shows a part sectional arrangement of a device according to a first dual flush embodiment of the invention, the valve being in the open position.

Thus FIG. 1 shows a cistern dual flush valve 33 fitted at the bottom of a cistern 1 and immersed in water to set level 23 at the instant of the main valve assembly 35 having just opened and having reached the top inside of upper housing 5.

Prior to actuation the valve 33 was of course closed, with the main valve assembly 35 including a piston 34 in the lower position such that the outlet 19, which is either directly connected to the back of the pan or connected by a short length of pipe, is empty and water in the cistern prevented from escaping unintentionally by main seal ring 11 sealing on main seat rim 13 and pilot seal 10 sealing against pilot valve shoulder (seat) 18. Under these conditions, with the cistern 1 filled to its set level 23 upper chamber 6 is at its maximum volume and contains mainly air (apart from a very small amount of water) at a pressure equal to the depth of water in the vicinity of pressure balance hole 9. To prevent water seeping through balance hole 9, across the top of the piston head 7, into the narrow gap between boss 36 and outside of hollow pilot stem 2 and through vent slots 44 into the hollow pilot stem and outlet 19, a seal 45 is provided. Thus seal 45 prevents water from leaking between the outer surface of pilot stem 2 and the inner surface of boss 36. A slight clearance must be present therebetween to enable movement of the pilot stem 2 inside of the boss 36. Other leakage paths which would occur are prevented by the caisson type overflow sleeve 58, the top edge of which determines the overflow level, and water overflowing this edge then gets away via slots 89 into hollow pilot stem 2. An upper stem extension piece 65 of the hollow stem 2 does not play any part in the overflow condition; it is there merely to ensure that the operating mechanism is kept above the maximum overflow height.

With the valve seated and the cistern filled, the piston 34 is kept in the seated condition mainly by net downward hydrostatic forces acting on the upper piston annular area between the pilot valve shoulder 18 and the bore of upper housing 5, the piston head 7 being sealed in the bore 31 of the upper housing by centering ring 8. Other downward forces are due to water pressure on the main seal ring 11 over the annular area between the main seat rim 13 and the piston body, weight of the piston 34 and possibly a small amount of initial compression from a control spring 90. The only upward force on the piston 34 in the seated condition is due to the water pressure acting on the annulus underneath the piston head 7, between the piston 34 and bore 31 of upper housing 5. The hollow pilot stem 2 does not contribute to these forces, it is maintained in the closed position or substantially the same by compression spring 4 acting on retaining collar 3. This is so because the pilot stem 2 can move independently of the main valve assembly 35. This is best illustrated in the related embodiment of FIG. 5 which shows the piston 34 in a lowered closed position and the pilot stem in substantially the same position as in FIG. 1.

The valve 33 is operated by imparting a downward movement onto the upper stem extension piece 65 which causes the pilot stem 2 to move down, opening the pilot seal 10 and the pilot valve shoulder 18. This immediately puts the upper chamber 6 in free communication with the outlet 19 via the inner piston annular passages 16 and 25 and for the pressure in the upper chamber 6 to almost instantly fall to approximately atmospheric pressure. As soon as this occurs the piston 34 is subjected to a net upward hydrostatic force which causes the air and small amount of water to be slightly compressed and rapidly ejected via the annular passages 16, 25 as the piston 34 rises to the top of the upper housing 5. (Passages 25 are provided by longitudinally-extending fins 24 on the outside of the lower end 26—tail piece—of the pilot stem 2.). During the rise of the piston 34, additional hydrostatic forces are imparted to the piston underside profile 20 and reaction forces due to the changing direction of flow between the contours of the profile 20 and the profile 115 substantially increase the upward force on the piston 34. However, also as the piston 34 rises, there is an increasing downward force due to the control spring 90 being compressed, but its stiffness is such that once the piston 34 has lifted off the main seat rim 13, the hydrostatic upward forces are sufficient to take the piston 34 to the fully raised position in the upper housing 5.

The pilot stem 2 is provided with one or more openings or vent slots 44 above its valve shoulder 18. During the opening of the valve 33 some of the air from the upper chamber 6 also escapes through vent slots 44 into the hollow pilot stem 2. With the valve 33 fully open, i.e. the piston 34 at the top inside the upper housing 5, the ingress of water is restricted to a very small amount via the pressure balance hole 9 and possibly via irregularities between the centering ring 8 and bore 31 of the upper housing 5, but this in total is very small and can escape from the bottom of the piston 34 at a rate far in excess of that at which it can enter.

With the valve 33 open and the pilot stem 2 released straight after the downward movement, the pilot valve shoulder 18 seals off the end of boss 36 by lightly compressing the seal 45 and thus no air can flow in or out from the upper chamber 6. Thus the valve 33 will fully discharge the cistern 1 down to lower level 22, at which point the surface of the outflowing water breaks clear of the lower piston edge 27 allowing air to vent upwardly into the upper chamber 6 and for the piston 34 to descend due to its own weight and the spring force and for reseating at the profile 115 of the main seat rim 13 to take place.

In the case of the dual flush, i.e. the short flush mode, operation of the valve 33 is somewhat different. This time, the upper stem extention piece 65 is pressed down and kept down for 2–3 seconds. Again, the downward movement opens pilot valve seal 10 and the pilot valve shoulder 18 and opens up a gap below boss 36 allowing a free communication between the inner piston annular passage 16 and the hollow pilot stem 2 via slots 44. With this venting between the upper chamber 6 and the hollow pilot stem 2 being maintained, the hydrostatic forces acting underneath the piston 34 reduce in proportion to the fall in water level so that on approaching the level 51 the weight of the piston 34 and force of the control spring 90 are sufficient to overcome the upward forces. As air can now be sucked freely through the vent slots 44 from the inside of the overflow, the piston 34 rapidly descends and reseats thus providing a short flush and discharging only approximately half the cistern contents. At the time of early reseating (short flushing) taking place, the outlet 19 contains water which, unlike with full flushing, has to be drained by venting air from the rim of the pan, but this only takes a few seconds and certainly will have taken place by the time the cistern has refilled to set level 23. (Refilling may be by conventional means.).

Figure 2:
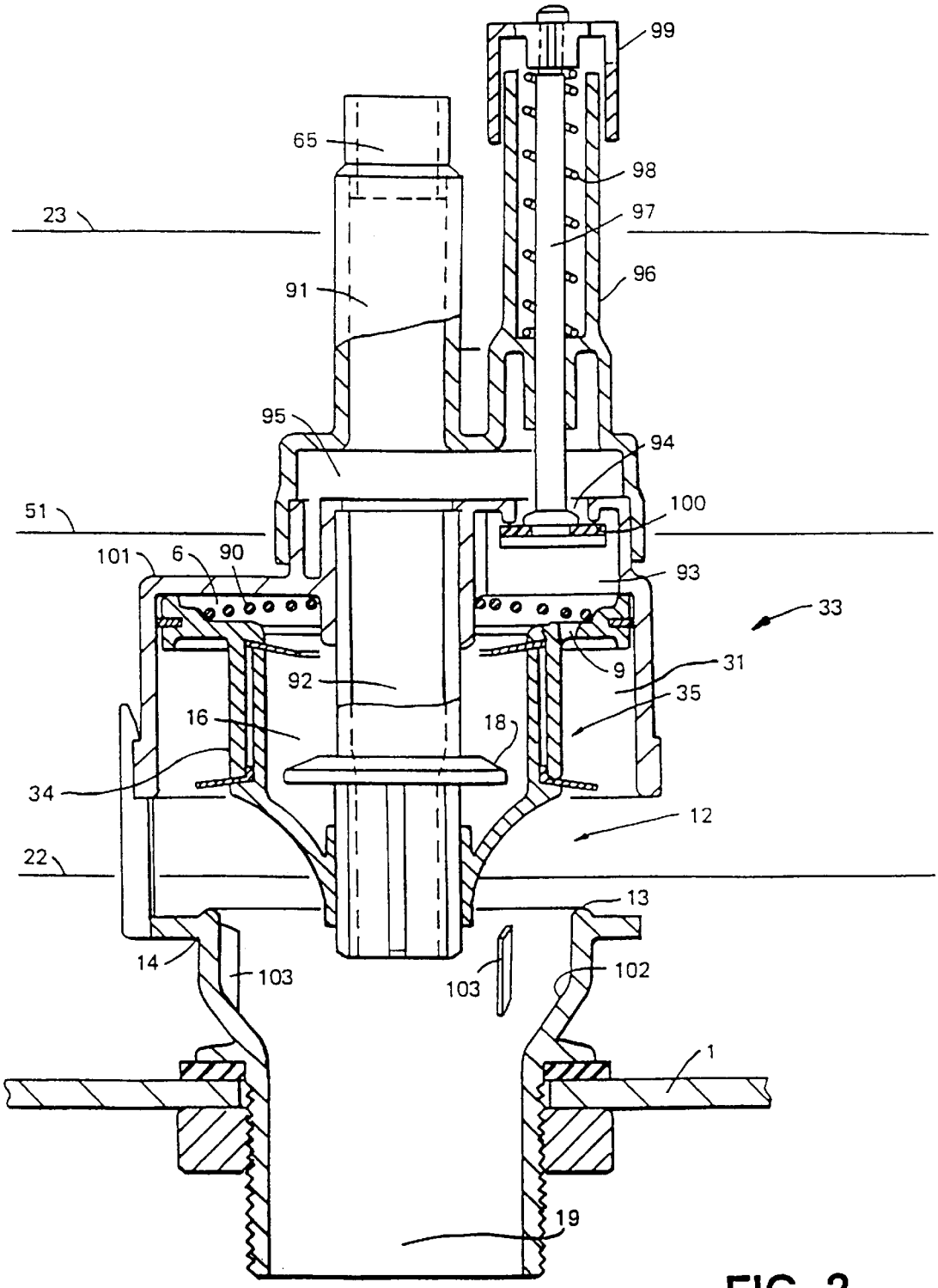
FIG. 2 shows a view similar to FIG. 1 of a second dual flush device of the invention, again the valve being in the open position.

FIG. 2 shows an arrangement functionally similar to FIG. 1, but configurationally different, whereby the main pilot valve 92 is integral with the upper housing 101 and the operable part of the pilot valve 92 is an off set auxiliary valve 94. With this arrangement, the upper housing 101 contains an upper chamber cavity 93 and the pilot valve seat 100 and the auxiliary valve 94 are kept seated by the upward force exerted on rod 97, which passes through a stack tube type housing 96, and which is exerted by spring 98 via auxiliary pilot spring cap 99 attached to the upper end of the rod 97. The top edge of the stack tube type housing 96 is above the maximum overflow level of the highest upper stem extension piece 65 and forms part of the same housing 96 which contains the overflow top pipe 91. Moreover, with this arrangement initial communication between the upper chamber 6 and the outlet 19 is via the upper chamber cavity 93, the auxiliary valve 94, the gallery 95 and the main pilot valve 92. Equally at this point air from the upper chamber 6 will flow out through overflow top pipe 91. The contour 102 of the outlet 19 is different to that of FIG. 1. It can under certain conditions give a marginal increase in flow rate. However webs 103 are required to prevent the piston 34 from being drawn into the outlet 19 if installed in a cistern 1 with exceptionally high level of water.

As before, to obtain the full flush mode the pilot valve 92 is pressed down and immediately released. In this case, of course, it is auxiliary pilot valve spring cap 99 which is pressed down to open auxiliary pilot valve 94 which in turn allows air to escape from the upper chamber 6. In some cases the upper chamber 6 could contain water if the pilot valve 92 has been kept open during refilling, in which case the water would be pushed into the gallery 95 and then flow through the pilot valve 92 and to outlet 19. Prior to the pilot valve 92 being actuated, the pilot valve is maintained in the closed position by the same hydrostatic forces as with FIG. 1 and when the valve is actuated the piston 34 lifts off the pilot valve shoulder 18 and the main seat rim 13 in the same way. In fact, functionally from hereon the action is identical to FIG. 1 and thus all identical or similar parts have the same significance as before.

For the short flush mode the auxiliary valve 94 is opened by pressing down on spring cap 99 and keeping it open for 2 to 3 seconds. Thus the main pilot valve 92 is opened and the piston 34 rises to the top of the upper housing 101. When the level has fallen from the set level 23 and approaching level 51, the compressive force on control spring 90 overcomes the net upward force causing the piston 34 to descend and draw air into the upper chamber 6 from the overflow gallery 95 via auxiliary valve 94 and cavity 93 to enable the piston 34 to rapidly descend and reseat—thus producing a short flush. All other functional aspects are the same as for FIG. 1.

Figure 3:
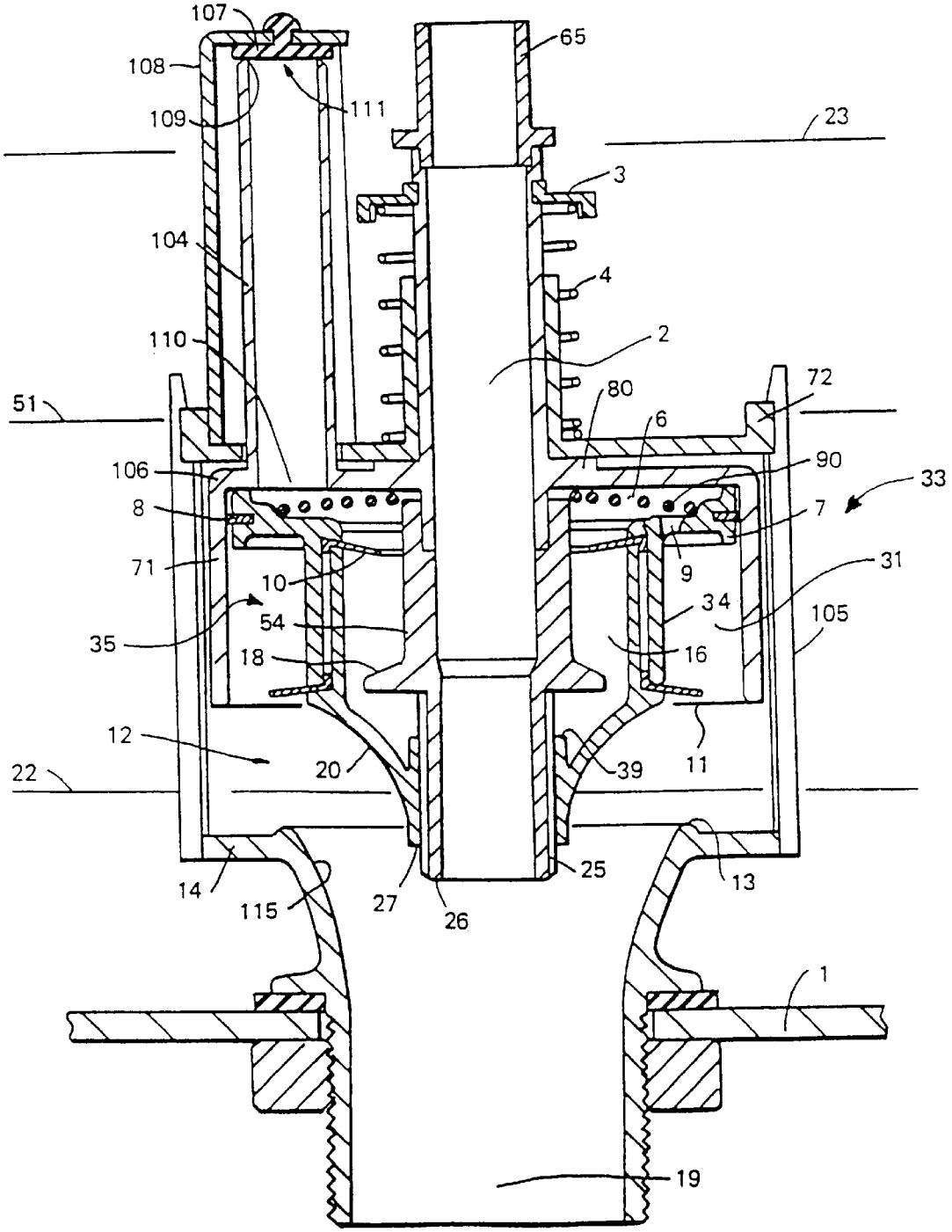
FIG. 3 is a similar view of a third dual flush device of the invention again with the valve in the open position.

FIG. 3 is similar in arrangement to FIGS. 1 and 2, but with the upper housing 106, pilot stem guide 54 and air stack pipe 104 being an integral assembly which on downward deflection causes pilot seal 10, pilot valve 18 and air vent valve 111 to open.

The valve 33 in FIG. 3 is shown in the open position with the piston 34 at the top, inside of upper housing 106 and with upper housing shoulder 80 abutting top housing 72 and rim 109 of air stack pipe 104 seated against seal pad 107. Bracket 108 is an integral part of top housing 72; seal pad 107 is attached at the top of bracket 108.

Thus, as with FIGS. 1 and 2, FIG. 3 shows a dual flush valve 33 at the bottom of cistern 1 and immersed in water soon after the main valve assembly 35 has opened and reached the top of upper housing 106 and with air vent valve 111 closed. Prior to actuation the valve 33 would of course be seated with piston 34 in the lower position and the cistern 1 filled to its set level 23. With the piston 34 in the lower position, water is prevented from escaping into the outlet 19 by main seal ring 11 being seated on main seat rim 13 and pilot seal 10 seated on pilot valve shoulder 18. Upper housing 106 is kept in the up position by compression spring 4 acting on retaining collar 3 via the integral pilot stem 2 to keep upper housing shoulder 80 abutted to the underside of top housing 72. This also maintains the correct position for the pilot stem guide 54 for seating the pilot seal 10 and the pilot valve shoulder 18. Airtight sealing of air vent valve 111 is also achieved by this same spring action.

With the cistern 1 filled to its set level 23, upper chamber 6 will be at its maximum volume and contain mainly air at a pressure equal to the depth of water in the vicinity of pressure balance hole 9. Air is prevented from escaping from the upper chamber by the air vent valve 111 and pilot seal 10. It will moreover be noticed that the air vent valve 111 is situated higher than the upper stem extention piece 65 and that there are no access slots in the extention piece/pilot stem 2 wall to allow air flow from the centre of the hollow pilot stem 2 to the upper chamber 6.

With the valve 33 seated and the cistern 1 filled, the piston 34 is maintained in the seated condition mainly by net downward hydrostatic forces acting on the upper piston annular area between the pilot valve shoulder 18 and the bore of upper housing 106—the piston head 7 being sealed in the bore and kept concentrically disposed in the upper housing 106 by centering ring 8. Other lesser downward forces are due to water pressure on the main seal ring 11 on the annular area between the seat rim 13 and piston 34, piston weight and possibly a small initial compression from control spring 90. In the seated condition, the only upward force is due to water pressure acting on the annulus underneath the piston head 7, between the piston 34 and bore of upper housing 106. The pilot stem guide 54 does not contribute to these forces, it is part of the upper housing/integral pilot hollow stem 2 and maintained in the upper position by spring 4—as described above.

The valve 33 is operated by imparting a downward movement onto upper stem extension piece 65, which causes the integral stem 2/upper housing 106/stack pipe 104/pilot stem guide 54 to move downwards—which opens pilot seal 10, pilot valve shoulder 18, and air vent valve 111. This immediately allows air and a small amount of water to escape into the outlet 19, which is initially empty, via the inner piston annular passages 16 and 25 and for air to also escape from the air valve 111. On establishing this communication between the upper chamber 6 and the outlet 19, almost instantly the pressure in the upper chamber drops to around atmospheric pressure with at the same time the piston 34 suddenly being subjected to a net upward hydrostatic force which causes the air and the small amount of water to be slightly compressed and rapidly ejected via the annular passages 16 and 25 and causes some air to flow through stack pipe 104 whilst air vent valve 111 is open and the piston 34 is rising to the top inside upper housing 106.

During the main valve assembly 35 rising to the open position, additional hydrostatic forces act on the piston underside profile 20 and to a lesser extent reaction forces due to rate of change of momentum of flow on contours of profiles 20, is substantially increase the upward force on the piston 34. As the piston 34 rises there is also an increasing downward force due to compression of control spring 90, but the stiffness and any initial compression is such that once the piston 34 has lifted off its seat the upward hydrostatic forces are sufficient to overcome the piston weight and spring forces and take the piston 34 up to the fully raised position in the upper housing 106.

Further to the initial escape of air and a small amount of water from the upper chamber 6 in the manner described above and the valve assembly 35 fully opened, the ingress of water into the upper chamber 6 is restricted to a very small amount via the pressure balance hole 9 and any irregularities between the outside of centering ring 8 and the base of the upper housing 106, but in any case water can escape from the upper chamber 6 via the open pilot valve shoulder 18 into the outlet 19 at a much greater rate than it can enter via said means.

With the valve 33 open and the upper housing 106 and hollow pilot stem 2 released straight after downward movement, the upper housing shoulder 80 abuts top housing 72 and air vent valve 11 is closed so that no air can flow into or out from the upper chamber 6 and annular passage 16. The water level inside the piston 34 during operation is confined to a few millimetres above the lower piston edge 27 in the annular passage 25. Thus with the valve assembly 35 having been opened and the air valve 111 closed, the cistern 1 will fully discharge from set level 23 down to empty level 22, at which point the surface of the outflowing water breaks away from the lower piston edge 27, allowing air to enter and vent upwardly via annular passages 16 and 25 to the upper chamber 6 and for piston 34 to descend, due to its own weight and the control spring force, to the reseated position.

For achieving the short flush mode, operation is initially as for the full flush mode whereby the valve assembly 35 is opened by downward movement of the extension piece 65 and upper housing 106 which opens pilot seal 10 pilot valve shoulder 18, and air vent valve 111 and the sudden imbalance of hydrostatic forces cause the piston 34 to rise off its seat in the same manner as already described. However, this time the upper housing 106, pilot stem guide 54 and stack pipe 104 are kept pressed down for 2 to 3 seconds. This ensures that the upper chamber 6 is vented to atmosphere via air vent valve 111, which is being held open, and that as the water level in the cistern 1 falls from set level 23 and approaches intermediate level 51, the diminishing hydrostatic forces acting underneath the piston 34 become insufficient to support the weight of the piston 34 and the control spring force. Moreover, with the air vent valve 111 open and air free to flow in and out of the upper chamber 6 via stackpipe 104 and port 110, the piston 34 rapidly descends to the reseated position and the premature closure of the valve 33 leaves water in the cistern at intermediate level 51.

Venting of the outlet 19 after a short flush or interruptable flush is achieved in the same manner as that described for FIGS. 1 and 2.

Figure 4:
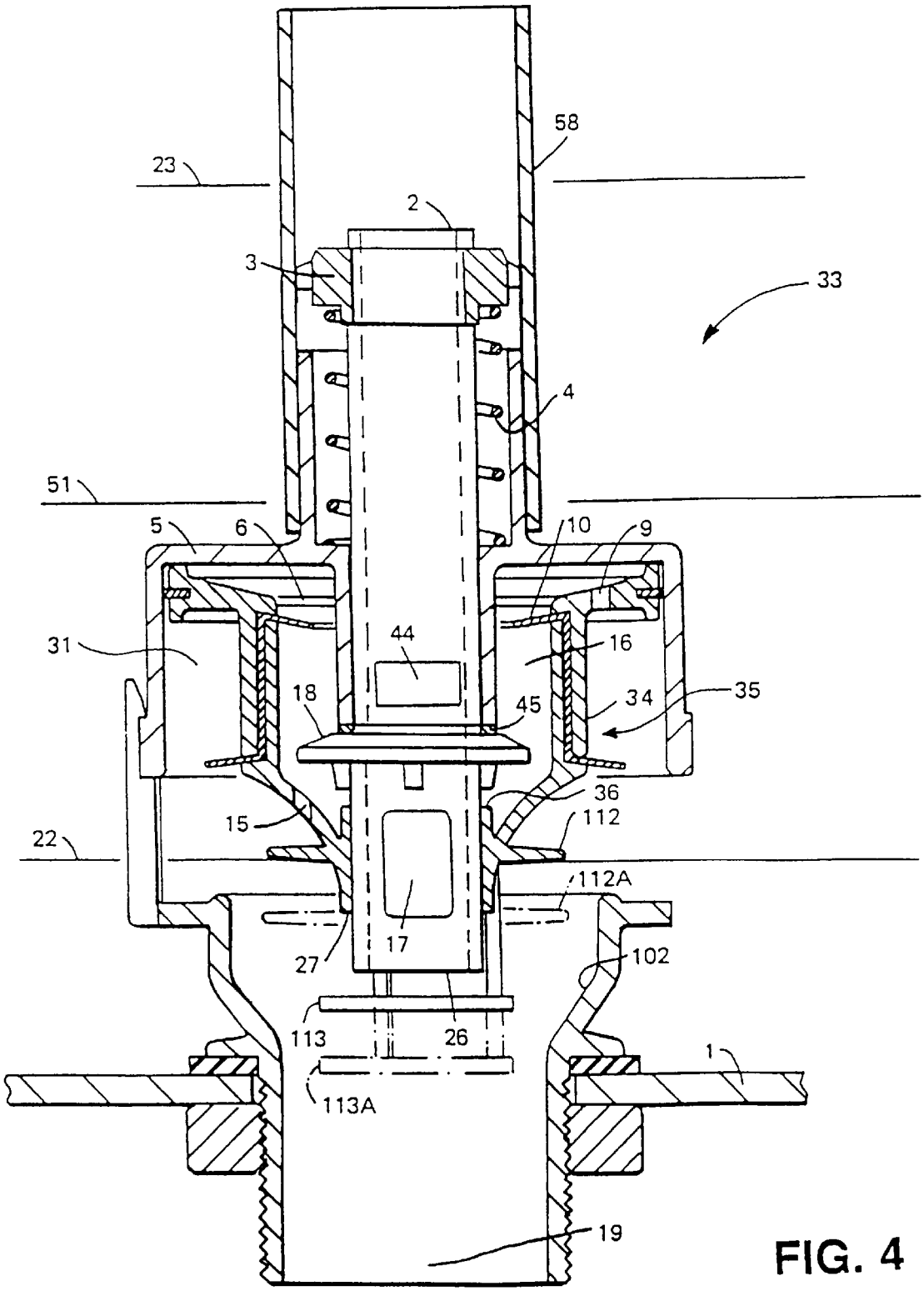
FIG. 4 is a similar view of a fourth dual flush device of the invention again in the open position.

FIG. 4 shows an arrangement similar to FIG. 1 except that the means for achieving the short flush is a drag ring 112 and drag disc 113 applied to the lower part of the piston 34 instead of the control spring 90 at the top of the piston. Also with this arrangement it is essential that the contour of the outlet 19 is similar to that shown in FIG. 2. Vent slots 44, 17 in the hollow pilot stem 2 are provided above and below the pilot valve shoulder 18.

The function; hydrostatic balance and basic operation is generally the same as that described for the embodiment shown in FIGS. 1, 2 and 3 and therefore again to produce the full flush mode the overflow extention piece 65/pilot stem 2 is pressed down and immediately released. This action as before drops the pressure in the upper chamber 6 to approximately atmospheric causing the main valve assembly 35 to unseat and as the main valve assembly rises to the top inside upper housing 5, air and a small amount of water is pushed downwardly via annular passage 16 and through slot hole 17 (which initially is fully uncovered with the top edge of lower piston guide boss 36 below it) into the hollow pilot stem 2 and down into the outlet 19. Initially with the hollow pilot stem 2 pressed down, air can also escape through slots 44 into the hollow pilot stem 2.

With the valve 33 open, the piston 34 at the top inside upper housing 5 and the slots 44 closed off by pilot valve shoulder 18 and seal 45 abutting the downwardly projecting boss of the upper housing 5, the upper chamber 6 is protected against the ingress of air from the bottom of the piston 34 via the slots 17 by a controlled amount of water entering hole 15 and surrounding the top edge of the lower piston guide boss 36. If air were allowed to enter the upper chamber 6 during the full flush mode premature reseating of the valve assembly 35 would occur unintentionally.

In the short flush mode as with the three previous embodiments the pilot hollow pilot stem 2 is pressed down and held down for 2 to 3 seconds. Unlike the other embodiments, however, the amount of downward movement is functional in creating downward forces on the piston 34. The underside of the pilot valve shoulder 18 engages with the top edge of the lower piston boss 36 causing the piston 34 to be moved down within the upper housing 5. Therefore, in the short flush mode with the piston 34 in the lower position 1 drag ring 112 and drag disc 113 (which in the fill flush mode do not impose any significant drag) are moved to their respective lower positions 112A and 113A where they set up downward forces on the piston 34 sufficient to overcome the upward hydrostatic acting underneath the piston 34 as the water level falls from the set level 23 and is approaching intermediate level 51. At this point with the vent slots 44 being open air enters the upper chamber 6 from inside the hollow pilot stem 2 causing the piston 34 to rapidly descend and reseat.

Following this short flush, the cistern 1 will refill to the set level 23 and be ready for the next full or short flush.

Figure 5:
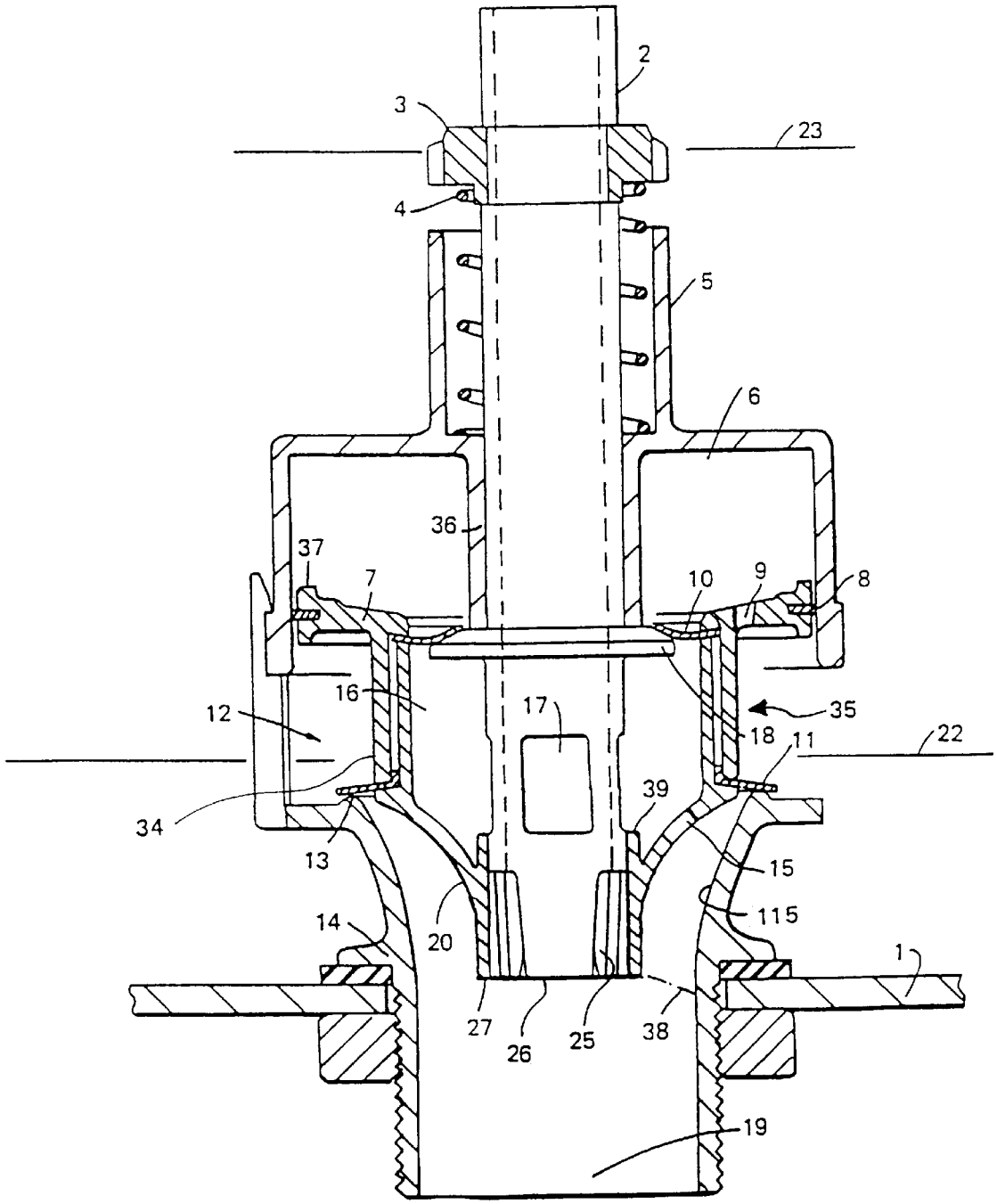
FIG. 5 is a similar view of a fifth device of the invention, being a single flush valve in the closed position.

FIG. 5 shows a full flush valve assembly 35 fitted at the bottom of a cistern 1 and immersed in water at a typical filled level 23 with the main seal ring 11 seated on main seat rim 13 sealing off the outlet and with pilot seal 10 sealing off against pilot valve shoulder 18 closing off upper chamber 6 from the outlet. With the valve assembly 35 seated and immersed in water, upper chamber 6 contains almost entirely air at a pressure equal to the surrounding water pressure, at the depth in the vicinity of the pressure balance hole 9. Generally due to the area on top of the main valve assembly 35 being larger than the annular area between the bore of upper housing 5 and main seat rim 13, a net downward force maintains the valve assembly in the seated condition. Also with the valve assembly 35 seated, the annular passage 16, hollow pilot stem (overflow) 2 and outlet 19 will be empty. The pilot stem 2 is maintained in the closed position by compression spring 4 exerting force on retaining collar 3 which in turn holds pilot valve shoulder 18 against the bottom of downward projecting boss 36.

The valve assembly 35 is operated by pressing the top of the pilot stem 2 which as before produces a downward movement of the pilot valve shoulder 18 away from pilot seal 10 creating a substantial opening and an immediate drop in pressure in the upper chamber 6 to approximately atmospheric pressure. This results in a net upward hydrostatic force and for the main valve assembly 35 to unseat and rapidly rise up into the upper housing 5 until the piston rim 37 reaches the top of the housing. This upward movement of the main valve assembly 35 causes air in the upper chamber 6 together with a small amount of water to be pushed downwards via the pilot seal 10 and annular space passage 16 through the slots 17 into the hollow centre of the pilot stem 2. At the same time, with the main seal ring 11 lifting from main seat rim 13 a substantial opening is provided for water to flow radially inwards via ports 12 and to be deflected downwards by the contour of the lower piston underside profile 20 and curved diverging contour of profile 115 of the outlet 19. The flow continues downwards via narrowing profile 38 into outlet 19 and thence into the toilet pan. Also, soon after the main valve assembly has lifted off its seat rim 13, water enters the lower piston tail into the passage 16 via access hole 15 and forming a shallow pool of water around the rim 39. At the start of the valve assembly 35 beginning to rise from its seat rim 13, air and water flow out through the slots 17 as quickly as they enter. As the main valve assembly 35 approaches the top of the upper chamber 6 the rim 39 overlaps the top edge of the slots 17 and water entering the hole 15 marginally rises above the rim 39 and seals off the space between the bore of the lower piston edge 27 and the pilot stem 2 above the top of the slots. As already described for the embodiment shown in FIG. 4, this water seal ensures that no air can enter the upper chamber 6 from the hollow pilot stem 2 via the slots 17 to cause premature reseating of the valve assembly 35 once the water level in the cistern 1 has fallen below the top of the main valve assembly 35 (rim 37) in the raised position. At this point there is not sufficient pressure or force underneath the main valve assembly 35 to sustain the weight of the piston 34 and thus it is essential that the piston remains in the raised position until the cistern 1 is empty, i.e. the water level is only slightly above the seat rim 13.

With there also being the need to ensure that neither air nor water enter the upper chamber 6 via the piston head 7 and also to accommodate fairly wide production tolerances, centralising center ring 8 is used. Some leakage is, of course, permitted via the centralising ring 8 but this is negligible and, of course, the pressure balance hole 9 allows a small flow into the upper chamber 6. As the water level in the cistern 1 drops down to the level of hole 15, the main valve assembly 35 begins to descend under its own weight by pulling in a small amount of water via the hole 15. The water level then drops still further until it reaches the point at which it is level with the bottom of the lower piston edge 27. This further assists with drainage of water from around the rim 39 via the hole 15 by venting air up into the passage 16 and breaking the water seal around the rim 39. This is then followed by initial downward movement of the main valve assembly 35 to uncover the top edges of the slots 17 and rapid venting causing the min valve assembly 35 to quickly descend and reseat.

With the contour of the lower piston profile 20 and the profile 115 of the mouth of the outlet 19 being designed to achieve high hydraulic efficiency, the venturi action at the narrowing profile 38 causes a partial vacuum and for there to be little or no water inside the hollow centre of the pilot stem 2 and therefore any communication path or transfer passage which would enable air to enter the upper chamber 6 during discharge is prevented.

Figure 6:
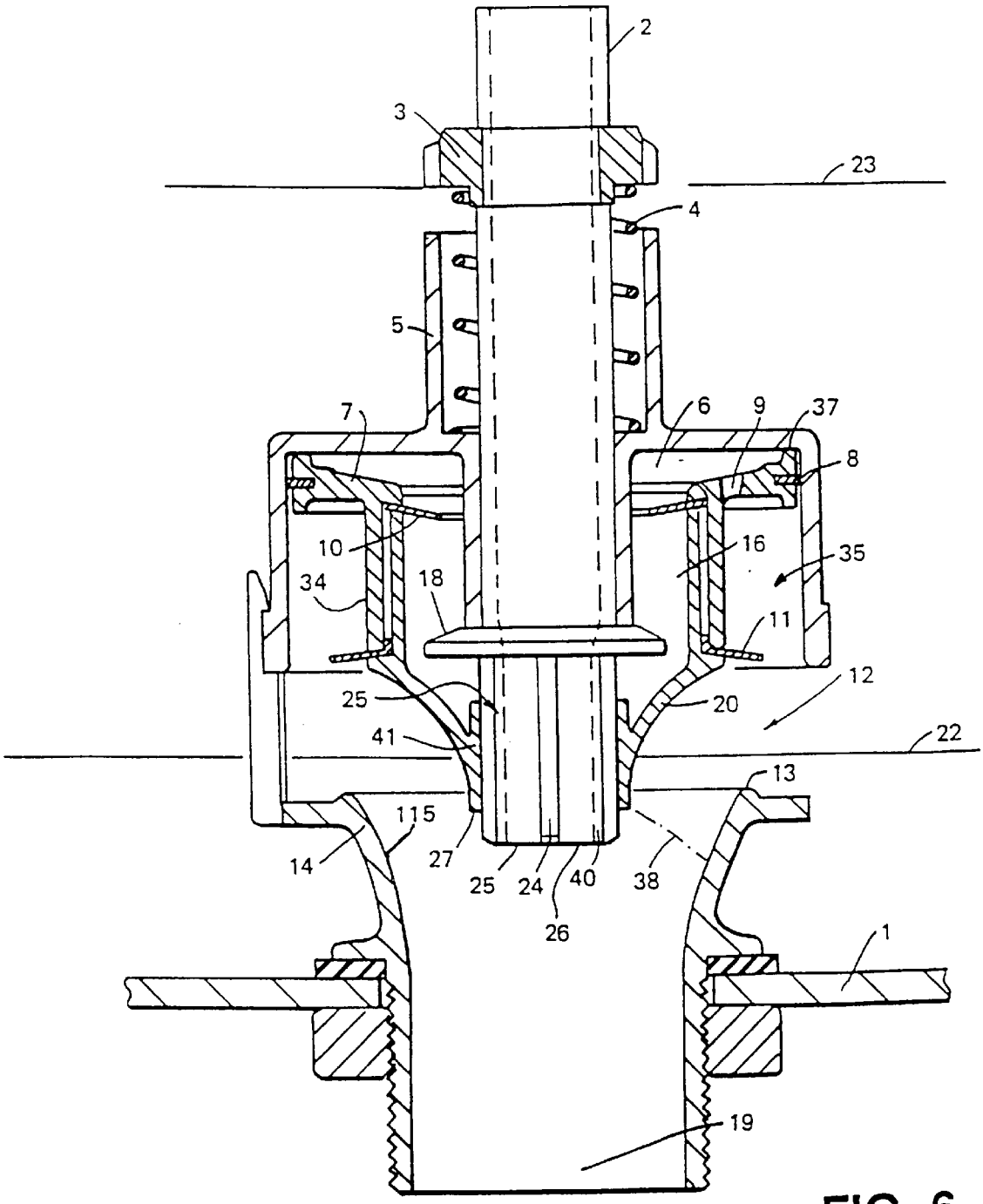
FIG. 6 is a similar view of a sixth device of the invention, being a single flush valve in the open position.

FIG. 6 shows an arrangement of the fill flush valve with integral overflow similar to FIG. 5 but with the main valve assembly 35 raised to the top inside the upper housing 5 i.e. the valve assembly 35 open. However, there are differences in the means by which the upper chamber 6 is controlled and the main valve assembly 35 kept in the raised position to achieve a high discharge efficiency and effective fast flowing emptying down to a level marginally above the main seat rim 13. Before operation,. i.e. the main valve assembly 35 closed and seated, the assembly would again be maintained in the seated mode by identical hydrostatic seating forces as for FIG. 5. With also. the configuration of the upper part of the main valve assembly 35, pilot stem 2, spring 4 and upper and lower housing assemblies being the same as before, the function and condition of such features as pressure balance hole 9, upper chamber 6, inner valve space 16 will also be the same as for the valve arrangement of FIG. 5 when seated and immersed in water.

This similarity also extends to the operation and opening of the valve wherein on pressing down the pilot stem 2, pilot seal 10 and pilot valve shoulder 18 opens allowing air initially at the same pressure as the water in the surrounding cistern 1 to escape from the upper chamber 6 into the annular passage 16 and downwards through the annular passage to the outlet 19. As before, this action causes the main valve assembly 35 to lift off seat rim 13 and rise to the fully opened position with the piston rim 37 at the top inside of the upper housing 5 and apart from a small quantity of water that enters the upper chamber 6 via the pressure balance hole 9 the top of the main valve assembly 35 is closed off by the center ring 8. Of course, up to the point where mainly air is being discharged into the inner annular passage 16 and downwards at approximately atmospheric pressure, operation is identical to that of FIG. 5.

The significant features and differences of FIG. 6 are mainly in the lower part of main valve assembly 35 and downwards extension regions of the pilot stem 2.

Air that is being expelled from the upper chamber 6 and flowing downwards through the annular passage 16 is turned radially inwards and enters the space defined between guide fins 24 and stem extention 40 at the outside of pilot stem 2. It then flows downwards through an annular passage 25, defined by the space between and outside of extensions 40 of pilot stem 2 and boss 41 interposed by fins 24, from the bottom of which it emerges at the lower piston edge 27 and flows beyond into the outlet 19. This flow is, of course, only present whilst the main valve assembly 35 is rising from its seat to the fully open position.

In the fully opened position, the highly efficient flow through the tapering duct (defined by the curved contours forming profile 20 on main valve assembly 35 and profile 115 of the outlet 19) creates a venturi action at the narrowing profile 38 which, in addition to the high downward velocity of the water impinging on the stem extension 40 between the lower piston edge 27 and stem bottom 26, sets up a substantial pressure reduction at the bottom of the piston 34 to ensure that apart from some water at the bottom of boss 41 and annular passage 25, the annular passage 16 and upper chamber 6 are drained at a rate exceeding the ingress of water, mainly from the pressure balance hole 9.

From the point at which the valve assembly 35 was operated with a cistern 1 filled to set level 23, water rapidly flows through the valve assembly 35 causing the water level to fall and for this to continue until the cistern 1 is empty and the water level reaches its lowest level as indicated 22. At this point the level of water at the centre surrounding the boss 41 dips downwards and falls below lower piston edge 27 allowing air to enter passage 25 and thence to the upper chamber 6 causing the main valve assembly 35 to descend rapidly and reseat. From here onwards refilling takes place and the cistern 1 then replenished with water to set level with the valve assembly closed and therefore ready for the next operation.

A number of alternative embodiments are possible. For example boss 36 in FIG. 1 could be eliminated and the height of the slots 44 raised above the top to position them inside the upper housing 5. This configuration would improve short flush performance on pans with restricted galleries and less than average performance.

I claim:

1. A discharge valve device for immersion in a fluid in a cistern, the device comprising an upper housing, an upwardly movable main valve assembly within the housing and forming, with the upper housing, a variable volume upper chamber, a restricted passage between the upper chamber and an exterior of the upper chamber, an outlet extending downward from a lower part of the upper housing the outlet having a seat rim for the main valve assembly so that, in a lowered position of the main valve assembly, the outlet is blocked against ingress of immersing fluid in which the device is immersed, and a pilot stem actuable remotely from the upper housing to put the upper chamber in free communication with the outlet, the arrangement being such that, when such free communication is established, fluid escapes the upper chamber and the change in relative pressures above and below the main valve assembly causes the main valve assembly to unseat thereby permitting flow of the immersing fluid into the outlet and substantially complete discharge of the immersing fluid from the cistern, the cessation of flow of the immersing fluid enables the main valve assembly to revert to a seated position with the pilot stem cutting off said free communication, and air penetrates the upper chamber and on replenishment of the immersing fluid a net downward pressure is created on the main valve assembly to keep the main valve assembly seated, and the pilot stem is hollow and communicates to atmosphere above a normal full set level of the immersing fluid in the cistern, the main valve assembly and the hollow pilot stem defining therebetween an annular passage.

2. A device according to claim 1, which operates as a dual flush valve having a short flush mode wherein a portion of the fluid in the cistern is released and a full flush mode wherein substantially all of the fluid in the cistern is released.

3. A device according to claim 2, wherein the discharge valve device is operable in the short flush mode by maintaining a vent to atmosphere from the upper chamber via the hollow pilot stem.

4. A device according to claim 3, wherein the vent to atmosphere from the upper chamber includes one or more slots in the hollow pilot stem above a pilot valve shoulder of the pilot stem which is to seal with the main valve assembly when the main valve assembly is closed.

5. A device according to claim 4, wherein the pilot stem additionally has one or more openings below the pilot valve shoulder.

6. A device according to claim 2, wherein a drag ring and a disc are provided on the main valve assembly to increase downward pressure on the main valve assembly.

7. A device according to claim 2, wherein the pilot stem is an integral part of the upper housing.

8. A device according to claim 7, wherein the free communication is provided by an offset auxiliary valve.

9. A device according to claim 2, wherein the upper housing and pilot stem are formed integrally with an air stack pipe, the air stack pipe providing the free communication when the pilot stem is forced downwards by an actuating mechanism.

10. A device according to claim 1, wherein the pilot stem is openable against pressure of a spring which returns the pilot stem to its closed position when an actuating mechanism is released.

11. A device according to claim 1, wherein a spring in the upper chamber is compressed between the main valve assembly and the upper housing whereby in a short flush mode, when the falling fluid level approaches the desired final short flush level the returning action of the spring and weight of the main valve assembly overcome upward forces on the main valve assembly.

12. A device according to claim 1, wherein the pilot stem has external longitudinally extending fins adjacent its lower end, which provide venting between the annular passage and the outlet when the main valve housing is in the open position.

13. A discharge valve device for immersion in a fluid in a cistern, the device comprising:

an upper housing;

a movable main valve assembly within the upper housing and forming with the upper housing a variable volume upper chamber;

a control spring in the upper chamber between the upper housing and the main valve assembly, the control spring biasing the main valve assembly downwardly;

a restricted passage between the upper chamber and an exterior of the upper chamber;

an outlet extending downward from the upper housing and main valve assembly and having a seat rim for seating the main valve assembly at the outlet in a seated position so that, in a lowered position of the main valve assembly, the outlet is blocked against ingress of fluid in which the valve device is immersed;

a pilot stem actuable remotely from the upper housing to put the upper chamber in free communication with the outlet; and a compression spring biasing the pilot stem to a closed position.

14. The device of claim 13, the device being arranged such that, when free communication is established between the upper housing and the outlet, fluid escapes the upper chamber and the change in relative pressures above and below the main valve assembly causes the main valve assembly to unseat and move upwardly, thereby permitting flow of the immersing fluid into the outlet and substantially complete discharge of the fluid, the cessation of flow of the immersing fluid enabling the main valve assembly to revert to the seated position with the pilot stem cutting off said free communication, and on replenishment of the immersing fluid a net downward pressure on the main valve assembly keeps the main valve assembly seated.

15. The device of claim 14, wherein the pilot stem is hollow and communicates to atmosphere above a normal full set level of the fluid, the main valve assembly and the hollow pilot stem defining therebetween an annular passage.

* * * * *